US009471078B1

(12) United States Patent
Guan et al.

(10) Patent No.: US 9,471,078 B1
(45) Date of Patent: Oct. 18, 2016

(54) ULTRA LOW POWER LOW DROP-OUT REGULATORS

(71) Applicant: QUALCOMM Incorporated, San Diego, CA (US)

(72) Inventors: Hua Guan, San Diego, CA (US); Vincenzo Peluso, San Diego, CA (US); Liangguo Shen, San Diego, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 0 days.

(21) Appl. No.: 14/675,262

(22) Filed: Mar. 31, 2015

(51) Int. Cl.
*G05F 1/575* (2006.01)

(52) U.S. Cl.
CPC ..... *G05F 1/575* (2013.01)

(58) Field of Classification Search
None
See application file for complete search history.

(56) References Cited

U.S. PATENT DOCUMENTS

| | | | | |
|---|---|---|---|---|
| 6,680,837 | B1 * | 1/2004 | Buxton | H02H 3/087 327/309 |
| 7,701,690 | B1 * | 4/2010 | Li | G05F 1/56 361/159 |
| 8,836,302 | B2 * | 9/2014 | Chen | G05F 1/56 323/274 |
| 2009/0128107 | A1 | 5/2009 | Wang et al. | |
| 2010/0259235 | A1 | 10/2010 | Ozalevli et al. | |
| 2013/0050288 | A1 * | 2/2013 | Kang | H05B 33/0815 345/690 |
| 2014/0084881 | A1 | 3/2014 | Shih et al. | |
| 2014/0117956 | A1 | 5/2014 | Price et al. | |
| 2014/0217950 | A1 | 8/2014 | Watanabe et al. | |
| 2014/0321227 | A1 | 10/2014 | Syed et al. | |
| 2014/0333382 | A1 | 11/2014 | Lautzenhiser | |
| 2014/0375354 | A1 | 12/2014 | Hoberman et al. | |
| 2015/0035505 | A1 | 2/2015 | Peluso | |

FOREIGN PATENT DOCUMENTS

| | | | |
|---|---|---|---|
| DE | 102008012392 | A1 | 9/2009 |
| EP | 1422588 | A1 | 5/2004 |
| KR | 20140033578 | A | 3/2014 |

OTHER PUBLICATIONS

International Search Report and Written Opinion—PCT/US2016/022449—ISA/EPO—May 27, 2016.

* cited by examiner

*Primary Examiner* — Emily P Pham
(74) *Attorney, Agent, or Firm* — Haynes and Boone, LLP

(57) ABSTRACT

In one embodiment, a low-dropout regulator comprises a pass transistor having a first terminal to receive an input voltage, a second terminal to provide an output voltage, and a gate terminal. A feedback circuit is coupled between the second terminal of the pass transistor and ground to generate a feedback voltage in response to the output voltage. A comparator has an output to generate a control voltage in response to the feedback voltage and a reference voltage. A switch is coupled between the output of the charge pump and the gate terminal of the pass transistor to selectively provide the control voltage to the gate terminal.

19 Claims, 8 Drawing Sheets

600

800

ULTRA LOW POWER LOW DROP-OUT REGULATORS

BACKGROUND

The disclosure relates to low drop-out regulators, and in particular, to ultra low power low drop-out regulators.

Unless otherwise indicated herein, the approaches described in this section are not admitted to be prior art by inclusion in this section.

Existing high load current rating low-dropout regulators (LDOs) have about a 10 microamp quiescent current even in a low power mode. There are typically tens of LDOs in a power management integrated circuit (PMIC) that in total contribute to a significant portion of the quiescent current of the PMIC. For the next generation chipsets, it is desired that these LDOs have a reduced quiescent current down to a 1 microamp level when the load is in a retention mode (of a memory, for example) or a sleep mode.

SUMMARY

The present disclosure provides low power low drop-out regulators. In one embodiment, a low-dropout regulator comprises a pass transistor having a first terminal to receive an input voltage, a second terminal to provide an output voltage, and a gate terminal. A feedback circuit is coupled between the second terminal of the pass transistor and ground to generate a feedback voltage in response to the output voltage. An error amplifier has an output to generate a control voltage in response to the feedback voltage and a reference voltage. A switch is coupled between the output of the error amplifier and the gate terminal of the pass transistor to selectively provide the control voltage to the gate terminal.

In one embodiment, the switch selectively provides the control voltage to the gate terminal during an ultra low power mode to maintain charge on the gate, and provides the control voltage to the gate terminal during a normal mode.

In one embodiment, the control voltage during an ultra low power mode to maintain is substantially identical to the control voltage during a normal mode.

In one embodiment, the comparator comprises a ultra low power mode controller to inject current on the gate of the pass transistor if the output voltage of the pass transistor is outside a voltage ripple window.

In one embodiment, the voltage ripple window is between the reference voltage and a voltage that is a maximum ripple voltage above the reference voltage.

In one embodiment, the ultra low power mode controller comprises a first comparator, a charge sink and a first charge switch to provide discharge current from the charge sink if the output voltage is above the voltage ripple window, and further comprises a second comparator, a charge source and a second charge switch to provide injection current if the output voltage is below the voltage ripple window.

In one embodiment, the first comparator and the second comparator are duty cycled during the ultra low power mode.

In one embodiment, the retention mode controller comparator further comprises an enable switch coupled between the second terminal of the transistor and the feedback circuit to selectively provide the output voltage to the feedback circuit.

In one embodiment, the feedback circuit has a variable resistor to adjust the feedback voltage based on a voltage ripple window. The retention mode controller comprises a comparator, a charge sink and a first charge switch to provide discharge current from the charge sink if the output voltage is above the voltage ripple window, and a charge source and a second charge switch to provide charge to the gate from the charge source if the output voltage is below the voltage ripple window.

In one embodiment, the retention mode controller comprises a comparator to generate a charge signal and a discharge signal in response to the feedback voltage, a charge pump, and a switching circuit to selectively charge the charge pump, and selectively couple the charge pump across the gate and a source of the pass transistor in response to the charge signal and the discharge signal.

In one embodiment, the retention mode controller comprises an analog-to-digital converter to digitize the feedback voltage, a digital compensator to generate a charge signal and a discharge signal in response to the feedback voltage, a charge pump, and a switching circuit to selectively adjust size of the charge pump, and selectively couple the charge pump across the gate and a source of the pass transistor in response to the charge signal and the discharge signal.

In one embodiment, the disclosure provides a method comprising generating in a pass transistor an output voltage in response to an input voltage; generating a feedback voltage in response to the output voltage; generating a control voltage in response to a comparison of the feedback voltage to a reference voltage; and selectively applying the control voltage to a gate terminal of the pass transistor.

In one embodiment, selectively applying the control voltage to a gate terminal of the pass transistor comprises selectively providing the control voltage to the gate terminal during an ultra low power mode to maintain charge on the gate, and providing the control voltage to the gate terminal during a normal mode.

In one embodiment, selectively applying the control voltage to a gate terminal of the pass transistor comprises injecting current on the gate of the pass transistor if the output voltage is outside a voltage ripple window.

In one embodiment, selectively applying the control voltage to a gate terminal of the pass transistor comprises injecting current on the gate of the pass transistor if the output voltage is below the voltage ripple window; and discharging current from the gate of the pass transistor if the output voltage is above the voltage ripple window.

In one embodiment, generating a feedback voltage in response to the output voltage comprises selectively generating the feedback voltage.

In one embodiment, the disclosure provides a low-drop-out regulator comprising means for generating in a pass transistor an output voltage in response to an input voltage; means for generating a feedback voltage in response to the output voltage; means for generating a control voltage in response to a comparison of the feedback voltage to a reference voltage; and means for selectively applying the control voltage to a gate terminal of the pass transistor.

In one embodiment, the means for electively applying the control voltage to a gate terminal of the pass transistor comprises means for selectively providing the control voltage to the gate terminal during an ultra low power mode to maintain charge on the gate, and means for providing the control voltage to the gate terminal during a normal mode.

In one embodiment, the means for selectively applying the control voltage to a gate terminal of the pass transistor comprises means for injecting current on the gate of the pass transistor if the output voltage is outside a voltage ripple window.

In one embodiment, the means for selectively applying the control voltage to a gate terminal of the pass transistor comprises means for injecting current on the gate of the pass transistor if the output voltage is below the voltage ripple window; and means for discharging current from the gate of the pass transistor if the output voltage is above the voltage ripple window.

In one embodiment, the means for generating a feedback voltage in response to the output voltage comprises means for selectively generating the feedback voltage.

The following detailed description and accompanying drawings provide a better understanding of the nature and advantages of the present disclosure.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, make apparent to those of skill in the art how embodiments in accordance with the present disclosure may be practiced. In the accompanying drawings.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

The disclosure describes circuits and methods for maintaining the output voltage of a low drop-out regulator (LDO) during an ultra low power mode. The ultra low power mode may be a mode where the LDO provides less current than the current provides during a normal power mode (hereinafter referred to as "normal mode") and may be, for example, a retention mode or a sleep mode. During these modes, the LDOs regulate the output voltage to reduce the quiescent current. The ultra low power is a mode with a lower power draw lower than a common low power mode which is a reduced quiescent current operation of convention analog control loops.

Figure 1:
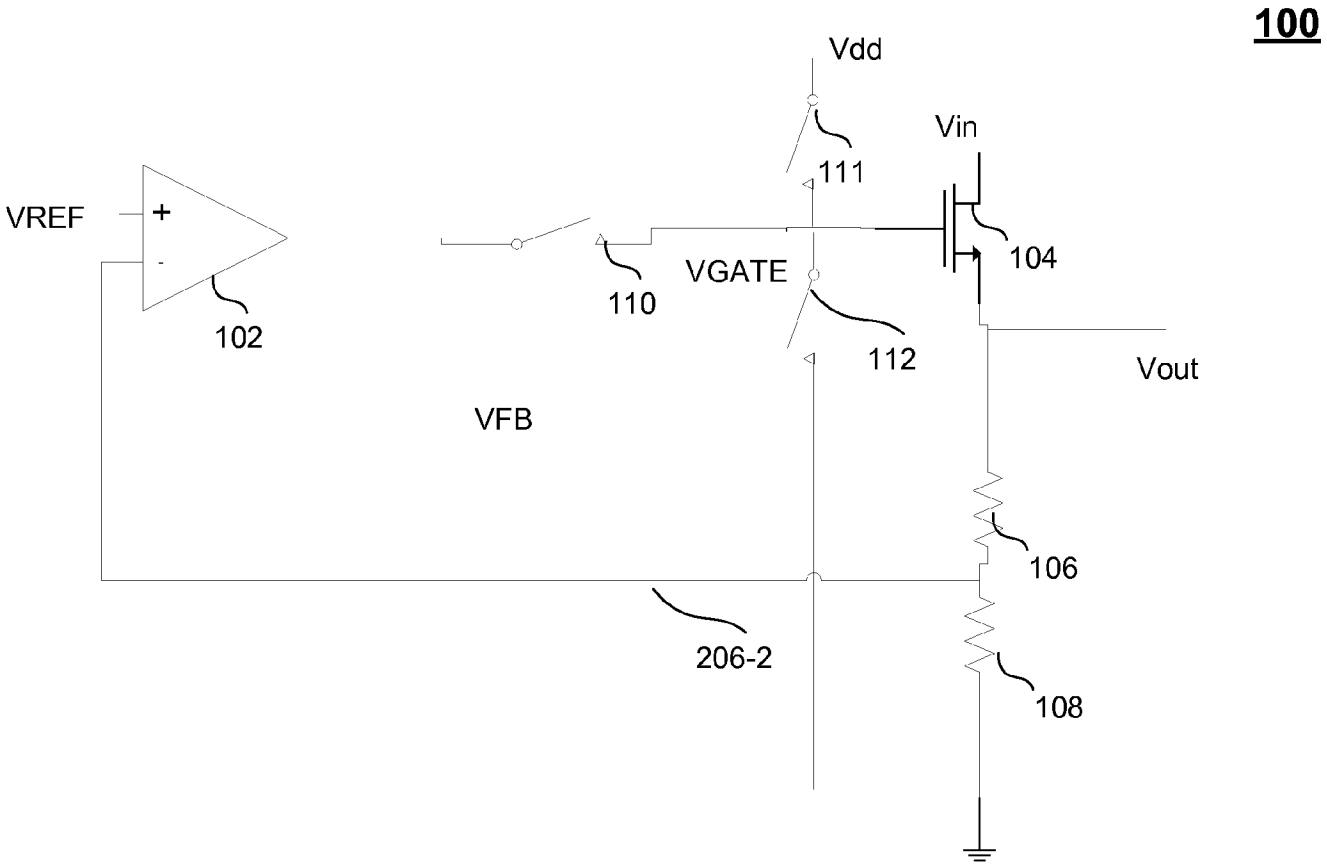
FIG. 1 illustrates a first low-dropout regulator according to some embodiments.

FIG. 1 illustrates a first low-dropout regulator (LDO) 100 according to some embodiments. LDO 100 comprises an error amplifier (or comparator) 102, a pass field-effect transistor (FET) 104, a plurality of resistors 106 and 108, and a plurality of switches 110, 111 and 112. LDO 100 operates in a normal mode and an ultra-low power mode. In the ultra-low power mode, switch 110 disconnects an output of error amplifier 102 from the gate of pass transistor 104, and a feedback ladder (in this example, comprising resistors 106 and 108 coupled in series between the source of pass transistor 104 and ground) provides a feedback voltage VFB to error amplifier 102 in response to the output voltage (source voltage) of pass transistor 104.

In the normal mode, switch 110 is closed. In the ultra low power mode, switch 110 is selectively closed to inject charge on the gate of pass transistor 104.

If the input voltage Vin, the output voltage Vout and the load current are static, Switch 110 can be open while external conditions are static. Then the quiescent current of LDO 100 can be zero. Gate charge may be lost due to leakage current or load current may fluctuate to cause a non-static case. Charge is adjusted on the gate of pass transistor 104 to compensate for the changes by charging up and down the gate with switches 111 and 112. LDO 100 has a high dynamic power loss due to the charging up and down of the gate of the high power pass transistor 104 at a high frequency.

Figure 2:
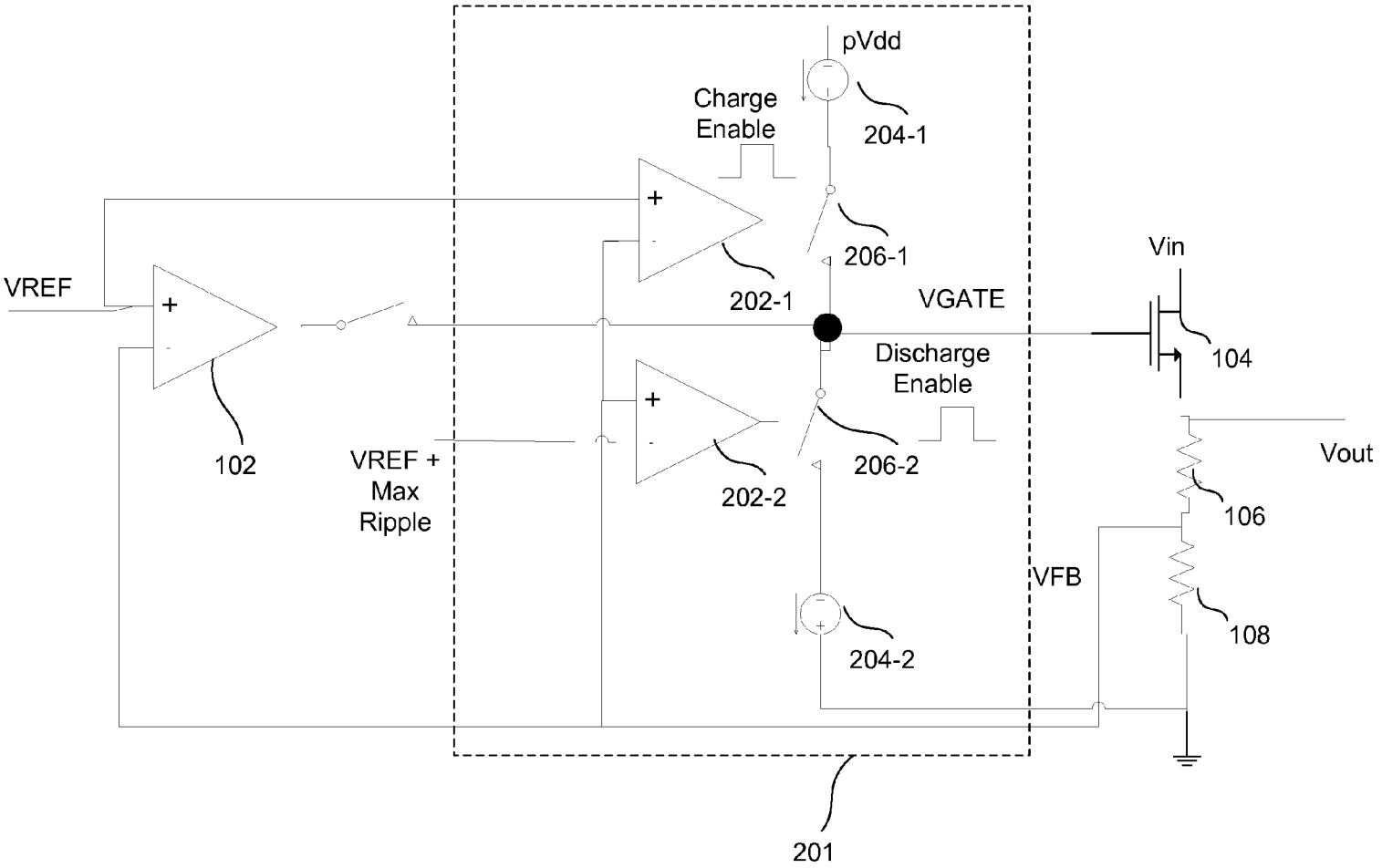
FIG. 2 illustrates a second low-dropout regulator according to some embodiments.

FIG. 2 illustrates a second low-dropout regulator 200 according to some embodiments. LDO 200 avoids the high dynamic power loss of LDO 100 by monitoring the gate voltage VGATE and injecting charge to compensate for leakage of pass transistor 104. LDO 200 is similar to LDO 100 and includes an error amplifier 102, a pass field-effect transistor (FET) 104, a plurality of resistors 106 and 108, and a switch 110.

LDO 200 further includes a retention mode controller 201 to inject current to the gate of pass transistor 104. Retention mode controller 201 injects charge on the gate of pass transistor 104 if the output voltage of pass transistor 104 is outside a voltage ripple window. In order to correct the gate voltage VGATE, retention mode controller 201 monitors the output voltage Vout and injects charge to the gate of pass transistor 104 if the output voltage drops out of a range of a reference voltage VREF and the reference voltage VREF plus a threshold (in this example, a maximum ripple).

Retention mode controller 201 comprises a first comparator 202-1, a first charge source 204-1, and a first charge switch 206-1 to provide injection current from the first charge source 204-1 to replenish the gate of pass transistor 104 if the output voltage VOUT is below the voltage ripple window (in this example, below the reference voltage VREF). First charge source 204-1 is enabled (by charge enable signal) by closing switch 206-1 when the output voltage VOUT is below the voltage ripple window.

Retention mode controller 201 further comprises a second comparator 202-2, a second charge source 204-2, and a second charge switch 206-2 to discharge injection current if the output voltage VOUT is above the voltage ripple window (In this example, above the reference voltage plus the maximum ripple). Second charge source 204-2 is enabled (by discharge enable signal) by closing switch 206-2 when the output voltage VOUT is above the voltage ripple window. Charge source 204 may be, for example, a charge pump or a current source.

By maintaining gate charge on the pass transistor 104, transitioning between normal mode and the ultra low power mode causes low output glitches. In the ultra low power mode, the modulation of the gate charge is relatively small to the large gate capacitance, so that the glitches are low.

Figure 3:
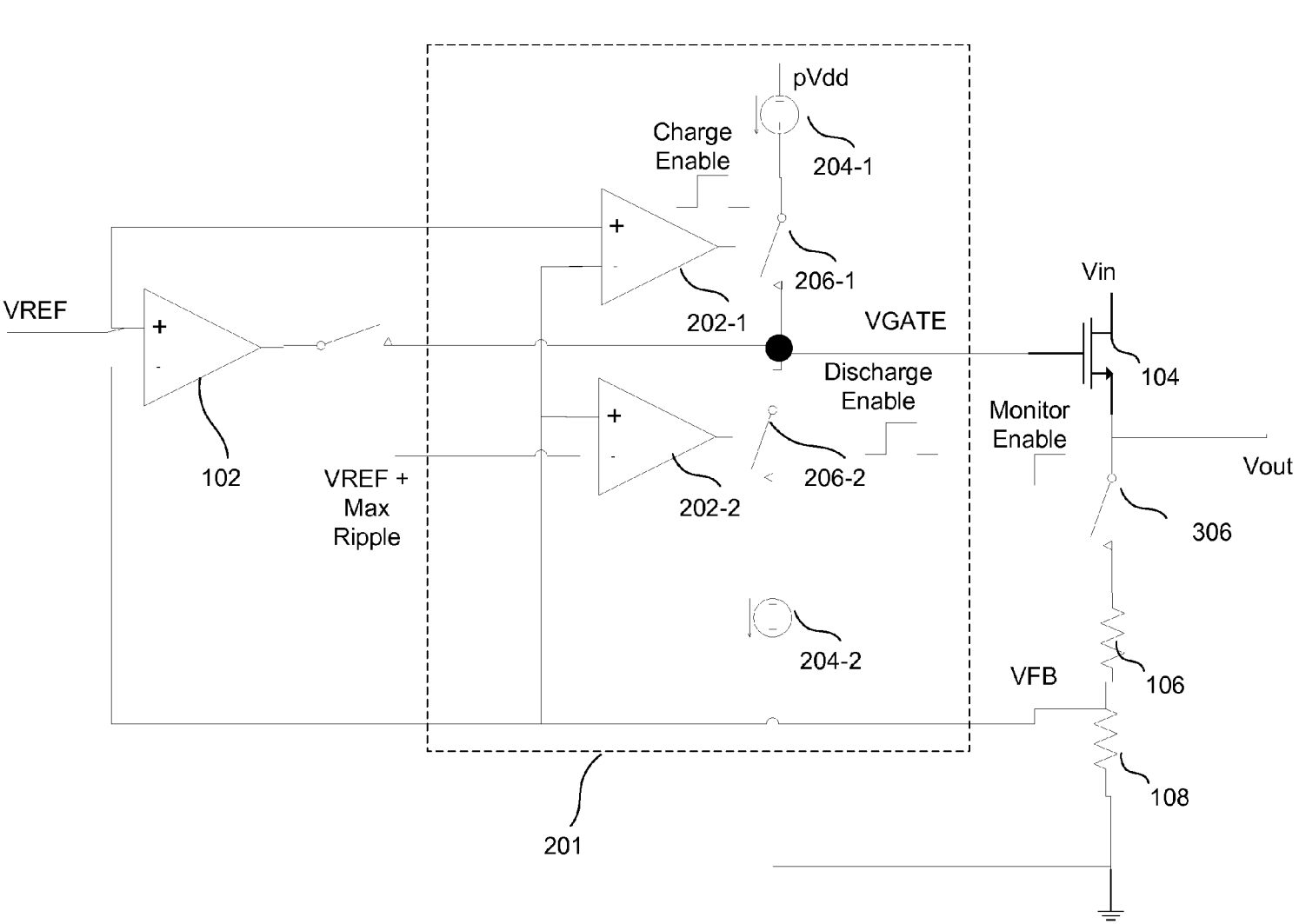
FIG. 3 illustrates a third low-dropout regulator according to some embodiments.

FIG. 3 illustrates a third low-dropout regulator (LDO) 300 according to some embodiments. LDO 300 is similar to LDO 200, but further includes a switch 306 to enable the feedback resistor ladder (formed of resistors 106 and 108. The comparators 202 and the feedback resistor ladder (resistors 106 and 108) may be periodically enabled to further reduce average quiescent current. The comparators 202-1 and 202-2 are enabled by a charge enable signal and a discharge enable signal, respectively.

In one embodiment, the comparators 202 are operated in low duty cycle, such as on for one microsecond and off for 30 microseconds.

Figure 4:
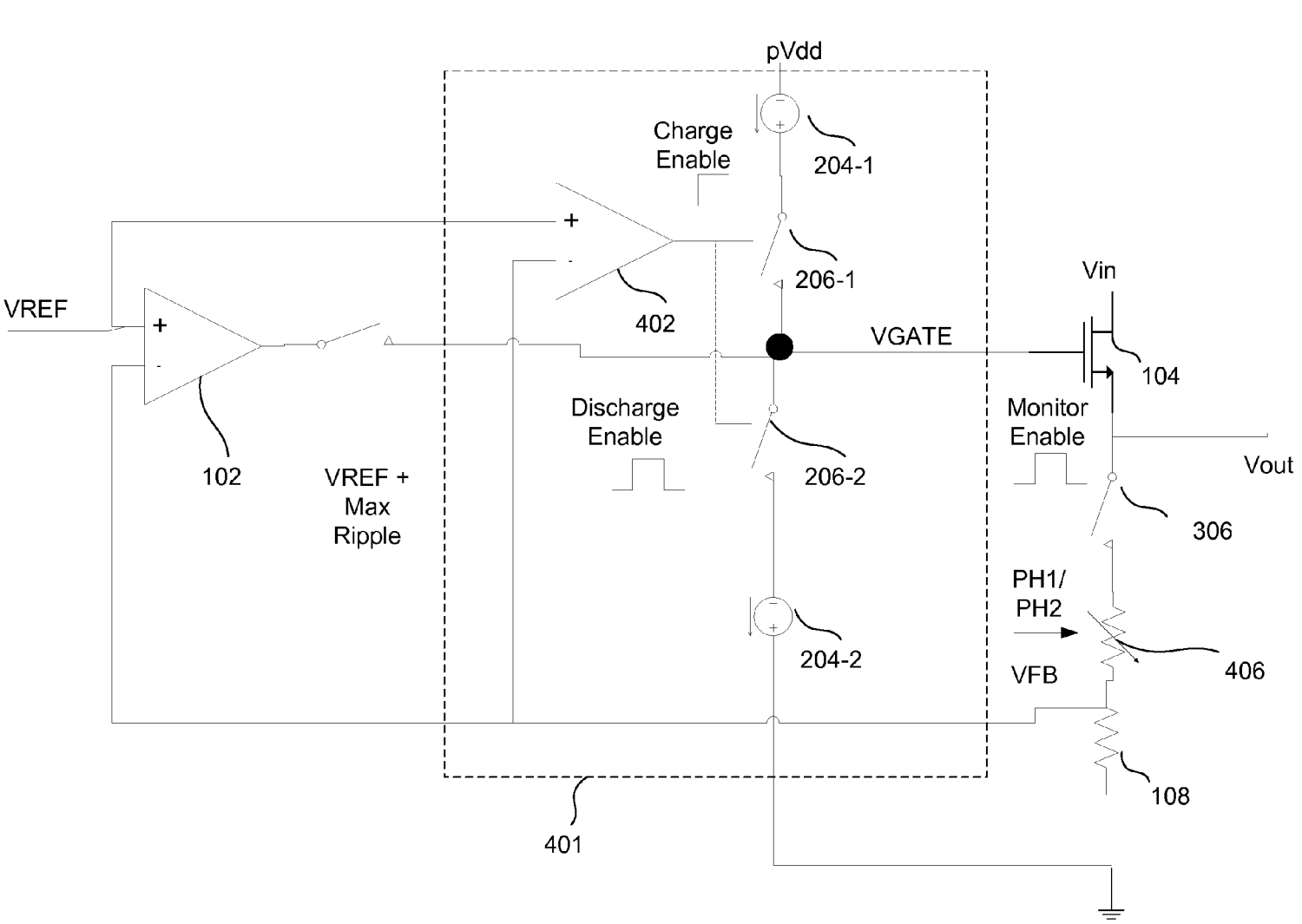
FIG. 4 illustrates a fourth low-dropout regulator according to some embodiments.

FIG. 4 illustrates a low-dropout regulator (LDO) 400 according to some embodiments. LDO 400 is similar to LDO 300 but includes a retention mode controller 401 instead of retention mode controller 301 and a variable resistor 406 instead of resistor 106. Retention mod controller 401 includes a single comparator 402 that controls switches 206-1 and 206-2 by a charge enable and a discharge enable, respectively, to selectively couple charge sources 204-1 and 204-2, respectively, to the gate of Pass FET 104. The resistance of resistor 406 is adjusted to set the feedback voltage VFB at an appropriate level based on a desired output voltage VOUT of a set voltage Vset plus a low hysteresis voltage Vhyst0 during a first phase (PH1) and a desired output voltage VOUT of a set voltage Vset plus a high hysteresis voltage Vhysthi during a second phase (PH2). An acceptable voltage ripple range may be used to determine the low hysteresis voltage Vhyst0 and the high hysteresis voltage Vhysthi. During each clock cycle, the first phase and the second phase are enabled so that comparator 402 compares the two voltages that are set during the two phases for an interleaved sampling. This increases the ability of the retention mode controller 401 to inject or remove charge from the gate of pass FET 104 and thereby increase the frequency of adjusting the charge on the gate.

Advantages of LDO 400 include one comparator rather than two comparators, which saves area and avoids a two comparator offset mismatch, which tightens the ripple of the output voltage VOUT.

Figure 5:
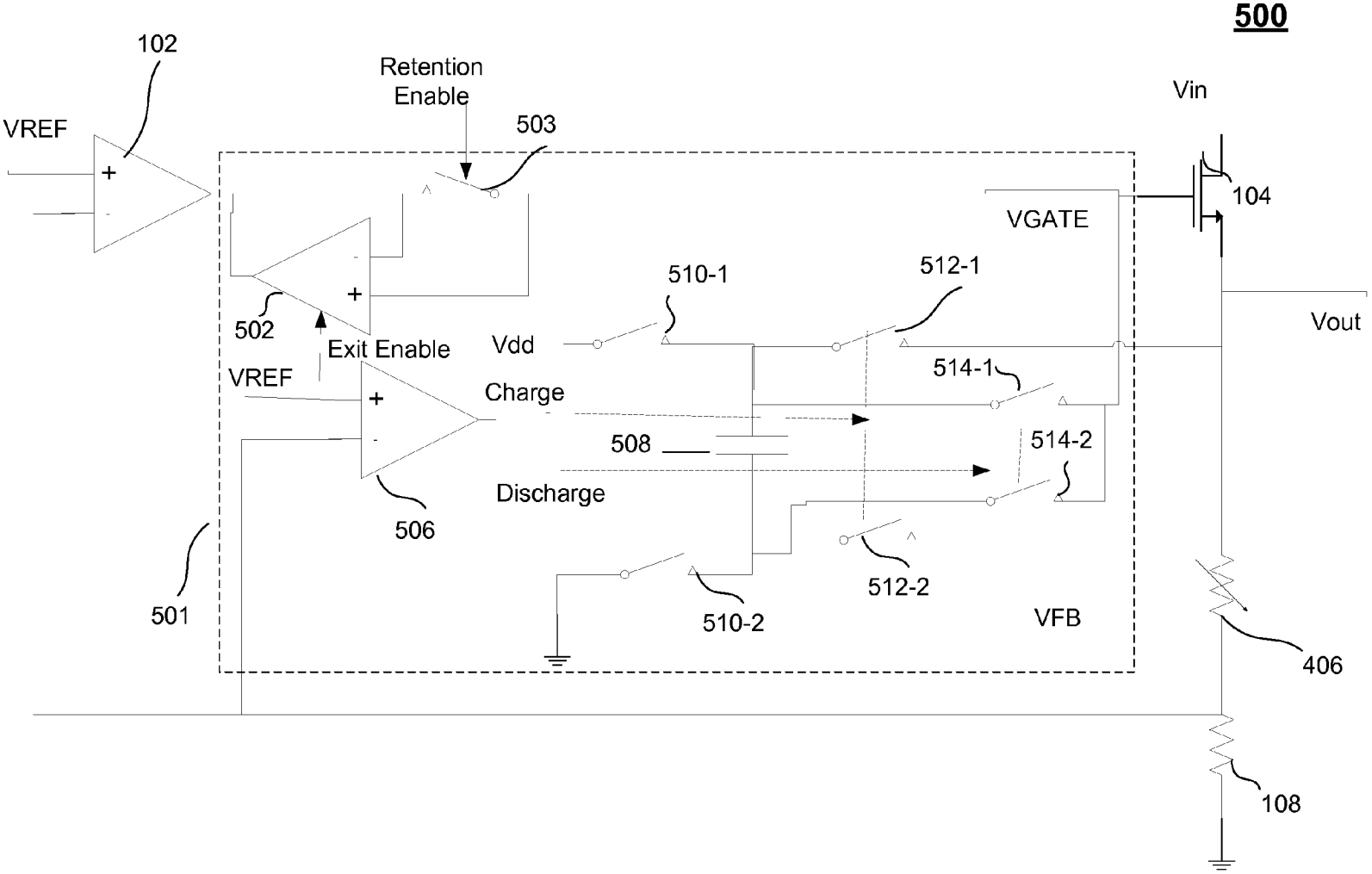
FIG. 5 illustrates a fifth low-dropout regulator according to some embodiments.

FIG. 5 illustrates a low-dropout regulator 500 according to some embodiments. LDO 500 comprises an error amplifier 102, a pass FET 104, a variable resistor 406, a resistor 108, and a retention mode controller 501. LDO 500 operates in a normal mode and an ultra-low power mode. Retention mode controller 501 comprises an exit amplifier 502 and a retention switch 503 that is closed by a Retention Enable signal during normal mode and upon exiting the ultra low power mode. In the normal mode, retention switch 503 is closed to complete the feedback loop of error amplifier 102, pass FET 104 and resistors 406 and 108. When the ultra low power mode is exited, retention switch 503 is still open before the ultra low power mode is exited and exit amplifier 503 is enabled by an exit buffer enable signal. Exit amplifier 502 forces error amplifier 102 equal to the retention mode controller regulated gate voltage, therefore when switch 503 is closed, the disturbance to the gate of pass FET 104 is minimized.

Figure 6:
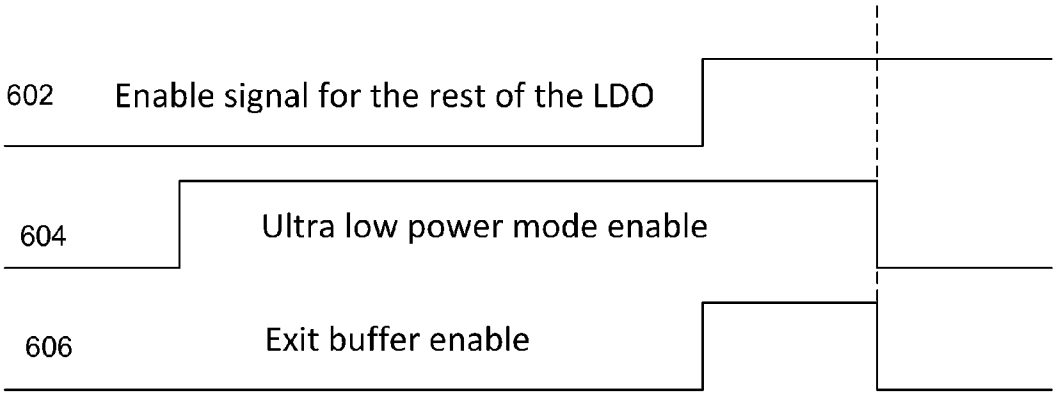
FIG. 6 illustrates a timing diagram of the fifth low-dropout regulator according to some embodiments.

FIG. 6 illustrates a timing diagram of the low-dropout regulator 500 according to some embodiments. A line 604 is a retention mode enable signal that enables the other portions of retention mode controller 501 as described below. Before retention mode enable is turned off, a line 602, which is an enable signal for the other parts of LDO 500, is turned on, and a line 604, which is the exit buffer enable signal, is also turned on. Lines 604 and 606 show both corresponding signals being turned off. During a normal mode to retention mode transition, switch 503 is opened to disconnect the gate to preserve the gate voltage, and thus, there is no or a small transient glitch. During the ultra low power mode to normal mode transition, exit amplifier 502 first is enabled to force the gate voltage of pass FET 104 to be equal to the actual gate voltage to reduce or minimize the transition glitch.

Referring again to FIG. 5, retention mode controller 501 is described for the ultra low power mode. Retention mode controller 501 comprises a comparator 506, a charge pump 508, a plurality of phase 1 switches 510-1 and 510-2, a plurality of phase 2 switches 512-1, 512-2, 514-1 and 514-2. During a phase 1, switches 510 are closed and switches 512 and 514 are open. A voltage Vdd (in this example, 1.8 volts) is applied across charge pump 508 to charge the charge pump 508. Charge pump 508 may be one or more charge pumps depending on the voltages and the size of capacitors that are desired. During a phase 2, switches 510 are open, and switches 212 and 514 are closed for charging or discharging, respectively, the gate of pass FET 104. Comparator 506 determines charging and discharging and the resistance of resistor 406 are set in a similar manner as comparator 402 and resistor 406 (FIG. 4). During charging, switches 512 are closed and switches 514 are open. Switches 512 couple charge pump 508 across the gate and source of the pass FET 104 to inject charge on the gate of the pass FET 104. During discharging, switches 512 are open and switches 514 are closed. Switches 514 couple charge pump 508 across the source and gate of the pass FET 104 (opposite polarity compared to charging) to remove charge on the gate of the pass FET 104.

Charge pump 508 replaces the charge source and charge sink of LDO 200. This results in no headroom limitation, avoids generation of nanoamp level currents that would otherwise be lost current in the ultra low power mode, and provides an automatic gate voltage clamp.

Figure 7:
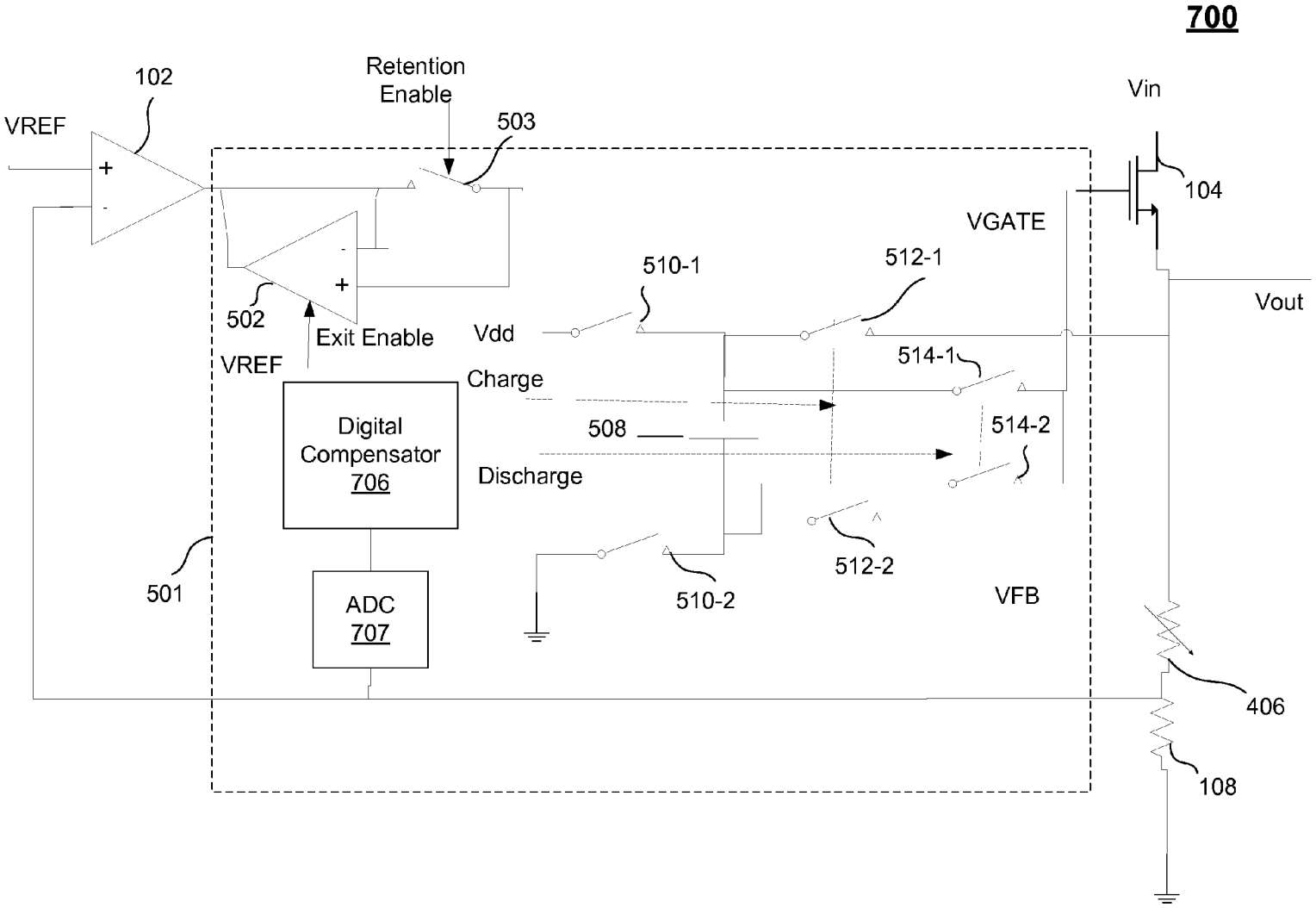
FIG. 7 illustrates a sixth low-dropout regulator according to some embodiments.

FIG. 7 illustrates a low-dropout regulator (LDO) 700 according to some embodiments. LDO 700 is similar to LDO 500, but includes a digital compensator 706 and an analog-to-digital converter (ADC) 707 instead of comparator 506. ADC 707 digitizes the feedback voltage VFB. Digital compensator 706 generates the charge and discharge signals. Charge pump 508 may have a plurality of capacitors that are selected in response to control signals from digital compensator 706. The adjusting of the capacitor size of charge pump 508 reduces ripple.

Figure 8:
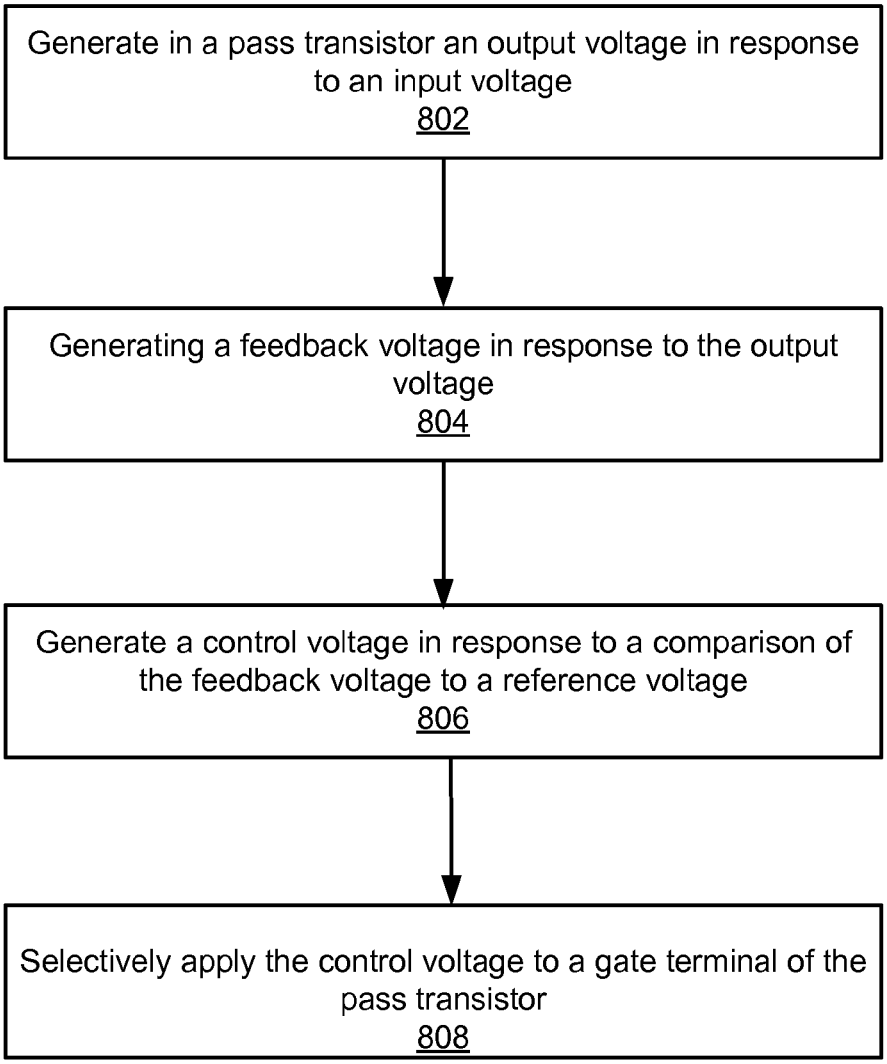
FIG. 8 is a process flow diagram illustrating a process flow of a low-dropout regulator according to some embodiments.

FIG. 8 is a process flow diagram illustrating a process flow 800 of a low-dropout regulator (e.g., LDO 100, LDO 200, LDO 300, LDO 400, LDO 500, or LDO 700) according to some embodiments. At 802, a pass transistor (e.g., pass transistor 104) generates an output voltage in response to an input voltage. At 804, a feedback voltage is generated in response to the output voltage. In one embodiment, the feedback voltage is selectively generated during an ultra low power mode. At 806, a control voltage is generated in response to a comparison of the feedback voltage to a reference voltage. At 808, the control voltage is selectively applied to a gate terminal of pass transistor 104. In one embodiment, the control voltage is selectively provided to the gate terminal during an ultra low power mode to maintain charge on the gate, and the control voltage is provided the control voltage to the gate terminal during a normal mode.

In one embodiment, the control voltage is selectively applied to a gate terminal of pass transistor 104 by injecting current on the gate of pass transistor 104 if the output voltage is outside a voltage ripple window.

In one embodiment, the control voltage is selectively applied to a gate terminal of pass transistor 104 by injecting current on the gate of pass transistor 104 if the output voltage is below the voltage ripple window, and discharging current from the gate of pass transistor 104 if the output voltage is above the voltage ripple window.

The switches described herein may be implemented by one or more transistors.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A low-dropout regulator comprising:

a pass transistor having a first terminal to receive an input voltage, a second terminal to provide an output voltage, and a gate terminal;

a feedback circuit coupled between the second terminal of the pass transistor and ground to generate a feedback voltage in response to the output voltage;

a comparator having an output to generate a control voltage in response to the feedback voltage and a reference voltage;

a switch coupled between the output of the comparator and the gate terminal of the pass transistor to selectively provide the control voltage to the gate terminal; and a low power mode controller to inject or discharge current on the gate of the pass transistor if the output voltage of the pass transistor is outside a window during a low power mode.

2. The low-dropout regulator of claim 1 wherein the switch selectively couples the output of the comparator to the gate terminal of the pass transistor so that the comparator provides the control voltage to the gate terminal during a normal mode and the low power mode controller provides the control voltage to the gate terminal during the low power mode to maintain charge on the gate.

3. The low-dropout regulator of claim 2 wherein the control voltage during the low power mode is substantially identical to the control voltage during the normal mode.

4. The low-dropout regulator of claim 1 wherein the comparator is an error amplifier.

5. The low-dropout regulator of claim 1 wherein the window is between the reference voltage and a voltage that is a maximum ripple voltage above the reference voltage.

6. The low-dropout regulator of claim 1 wherein the low power mode controller comprises a first comparator, a charge sink, and a first charge switch to provide discharge current if the output voltage is above the window, and further comprises a second comparator, a charge source, and a second charge switch to provide injection current if the output voltage is below the window.

7. The low-dropout regulator of claim 6 wherein the first comparator and the second comparator are duty cycled during the low power mode.

8. The low-dropout regulator of claim 6 further comprising an enable switch coupled between the second terminal of the pass transistor and the feedback circuit to selectively provide the output voltage to the feedback circuit.

9. The low-dropout regulator of claim 1 wherein the feedback circuit has a variable resistor to adjust the feedback voltage based on the window, and the low power mode controller comprises a comparator, a charge sink, and a first charge switch to provide discharge current from the gate if the output voltage is above the window, and a charge source and a second charge switch to provide injection current to the gate if the output voltage is below the window.

10. The low-dropout regulator of claim 1 wherein the low power mode controller further comprises a comparator to generate a charge signal and a discharge signal in response to the feedback voltage, a charge pump, and a switching circuit to selectively charge the charge pump and selectively couple the charge pump across the gate and the second terminal of the pass transistor in response to the charge signal and the discharge signal.

11. The low-dropout regulator of claim 1 wherein the low power mode controller comprises an analog-to-digital converter to digitize the feedback voltage, a digital compensator to generate a charge signal and a discharge signal in response to the feedback voltage, a charge pump, and a switching circuit to selectively adjust a size of the charge pump and selectively couple the charge pump across the gate and the second terminal of the pass transistor in response to the charge signal and the discharge signal.

12. A method comprising:

generating in a pass transistor an output voltage in response to an input voltage;

generating a feedback voltage in response to the output voltage;

generating a control voltage in response to a comparison of the feedback voltage to a reference voltage; and selectively applying the control voltage to a gate terminal of the pass transistor, wherein selectively applying the control voltage to a gate terminal of the pass transistor comprises injecting or discharging current on the gate of the pass transistor if the output voltage is outside a window during a low power mode.

13. The method of claim 12 wherein selectively applying the control voltage to a gate terminal of the pass transistor further comprises:

selectively injecting current to the gate terminal during the low power mode to maintain charge on the gate, and providing the control voltage to the gate terminal from an error amplifier during a normal mode.

14. The method of claim 12 wherein the window is between the reference voltage and a voltage that is a maximum ripple voltage above the reference voltage.

15. The method of claim 12 wherein selectively applying the control voltage to a gate terminal of the pass transistor comprises:

injecting current on the gate of the pass transistor if the output voltage is below the window; and discharging current from the gate of the pass transistor if the output voltage is above the window.

16. The method of claim 15 wherein generating a feedback voltage in response to the output voltage comprises selectively generating the feedback voltage.

17. A low-dropout regulator comprising:

means for generating in a pass transistor an output voltage in response to an input voltage;

means for generating a feedback voltage in response to the output voltage;

means for generating a control voltage in response to a comparison of the feedback voltage to a reference voltage; and means for selectively applying the control voltage to a gate terminal of the pass transistor, wherein means for selectively applying the control voltage to a gate terminal of the pass transistor comprises means for injecting or discharging current on the gate of the pass transistor if the output voltage is outside a window during a low power mode.

18. The low-dropout regulator of claim 17 wherein means for selectively applying the control voltage to a gate terminal of the pass transistor comprises:

means for selectively providing the control voltage to the gate terminal during the low power mode to maintain charge on the gate, and means for providing the control voltage to the gate terminal during a normal mode.

19. The low-dropout regulator of claim 1 wherein the comparator is an error amplifier, the low-dropout regulator further comprising an amplifier having a first input coupled to a first terminal of the switch, a second input coupled to a second terminal of the switch, and an output coupled to the output of the error amplifier, the amplifier configured to force an output voltage of the error amplifier to equal a voltage on the gate of the pass transistor before the switch is closed.

* * * * *